US012114794B2

(12) United States Patent
Taylor

(10) Patent No.: US 12,114,794 B2
(45) Date of Patent: Oct. 15, 2024

(54) DRESSING AID

(71) Applicant: Kevin Darrell Taylor, Far West, UT (US)

(72) Inventor: Kevin Darrell Taylor, Far West, UT (US)

( * ) Notice: Subject to any disclaimer, the term of this patent is extended or adjusted under 35 U.S.C. 154(b) by 10 days.

(21) Appl. No.: 18/190,087

(22) Filed: Mar. 26, 2023

(65) Prior Publication Data

US 2023/0301452 A1 Sep. 28, 2023

Related U.S. Application Data

(60) Provisional application No. 63/324,083, filed on Mar. 27, 2022.

(51) Int. Cl.
*A47G 25/80* (2006.01)

(52) U.S. Cl.
CPC ..... *A47G 25/80* (2013.01)

(58) Field of Classification Search
CPC ..... A47G 25/80; A47G 25/90; A47G 25/82; A47G 25/84; A47G 25/905; A47G 25/907; A47G 25/908
See application file for complete search history.

(56) References Cited

U.S. PATENT DOCUMENTS 3,993,228 A * 11/1976 Fuhr ..... A47G 25/905 223/111
6,932,252 B2 * 8/2005 Simmons ..... A47G 25/905 223/111
2009/0120975 A1 * 5/2009 Schoepe ..... A47G 25/905 223/111
2010/0200622 A1 * 8/2010 Fusaro ..... A47G 25/90 223/111
2015/0115001 A1 * 4/2015 Boaron ..... A47G 25/905 223/111

FOREIGN PATENT DOCUMENTS

GB 2020540 A * 11/1979 ..... A47G 25/905
WO WO-03096851 A1 * 11/2003 ..... A47G 25/905

* cited by examiner

*Primary Examiner* — Ismael Izaguirre

(57) ABSTRACT

A dressing aid is disclosed. The dressing aid includes a sock aid comprising: a sock canister comprising: a reinforced edge; a heel transition opening; a pivot aperture; a connection disk comprising; an axle for the pivot aperture to rotate on; a handle connection mechanism; a push retainer for holding the connection disk to the sock canister; a handle. The disclosure further provides a position lock; wherein the sock canister is configured to enable a sock to be placed on it to facilitate putting a sock on a foot; wherein the sock canister rotates around the axle of the connection disk enabling the sock canister to rotate as a foot is placed in the sock, and to remove the sock from the canister as the foot is placed in the sock.

20 Claims, 7 Drawing Sheets

DRESSING AID

CROSS REFERENCE TO RELATED APPLICATION

The present application claims priority to U.S. Provisional Patent No. 63/324,083 entitled, "Dressing Aid," filed Mar. 26, 2022.

TECHNICAL FIELD

This invention relates to dressing aids or dressing assist devices.

BACKGROUND

Putting clothes on can be a challenge. As an individual ages, or recovers from injury, bending can become more difficult.

SUMMARY

In a first aspect, the disclosure provides a dressing aid. The dressing aid includes a sock aid comprising: a sock canister comprising: a reinforced edge; a heel transition opening; a pivot aperture; a connection disk comprising; an axle for the pivot aperture to rotate on; a handle connection mechanism; a push retainer for holding the connection disk to the sock canister; a handle.

In a second aspect, the disclosure provides a dressing aid. The dressing aid includes a sock aid comprising: a sock canister comprising: a reinforced edge; a heel transition opening; a pivot aperture; a connection disk comprising; an axle for the pivot aperture to rotate on; a handle connection mechanism; a push retainer for holding the connection disk to the sock canister; a handle; a dressing hook; a shoehorn; a sock remover.

In a third aspect, the disclosure provides a dressing aid. The dressing aid includes; a sock aid comprising: a sock canister comprising: a reinforced edge; a heel transition opening; a pivot aperture; a connection disk comprising; an axle for the pivot aperture to rotate on; a handle connection mechanism; a push retainer for holding the connection disk to the sock canister; a handle; a position lock; wherein the sock canister is configured to enable a sock to be placed on it to facilitate putting a sock on a foot; wherein the sock canister rotates around the axle of the connection disk enabling the sock canister to rotate as a foot is placed in the sock, and to remove the sock from the canister as the foot is placed in the sock.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

The Reach Right (and Reach Right+ model variation with extra pull handles) is a 4-in-1 dressing aid device that has a Shoehorn, Sock Remover, Dressing Hook and a Sock Aid. The Sock Aid is a unique design that is capable of putting on ankle socks and even compression socks.

With several interlocking pieces that can be taken apart as needed the Reach Right is ideal for travel. When fully extended the Reach Right dressing hook is 36" in length.

Figure 2:
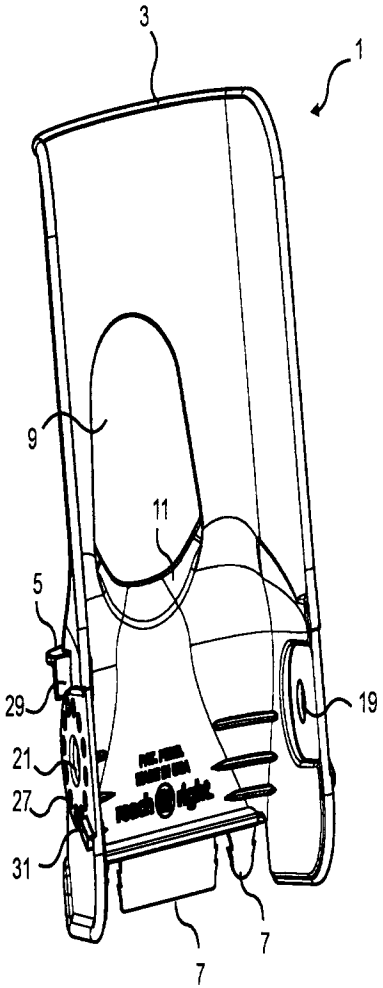
FIG. 2 is a front view of a sock canister.
Figure 1:
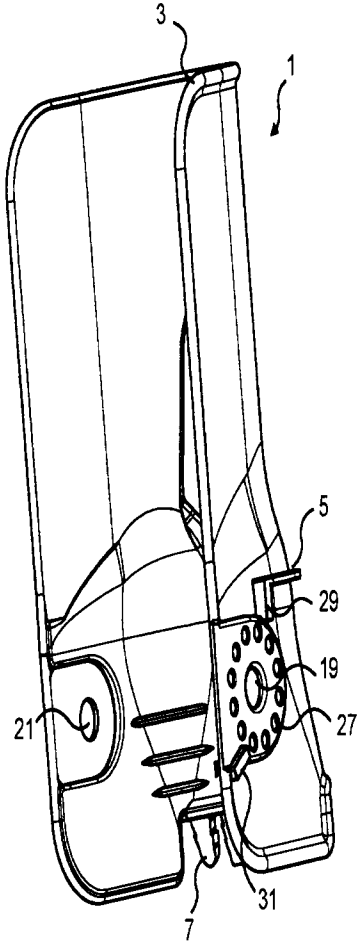
FIG. 1 is a perspective view of a sock canister.

A sock aid is used to assist in putting socks on. The sock aid includes several components, referring to FIGS. 1 and 2 a sock canister 1 is a modified half cylinder with an open front and an enclosed back. The sock canister 1 is designed to assist in holding a sock open while the foot is inserted into the sock. A material that is firm enough to keep its shape and open the sock while having enough give to comfortably allow movement is desirable. In some embodiments, the material of the canister is plastic. In some embodiments, the plastic is polypropylene plastic. In some embodiments, the plastic is another plastic such as polyurethane plastic, High density polyethylene (HDPE), or other suitable plastics. In some embodiments, the canister is made from another synthetic material such as carbon fiber, grilamid, fiberglass reinforced nylon (FRN), or other manufactured materials. In some embodiments, the canister is made from a metal. In some embodiments, the metal is aluminum, or an aluminum alloy. In some embodiments, the metal is stainless steel. In other embodiments, the metal is titanium, magnesium, or alloys of these metals.

Figure 3:
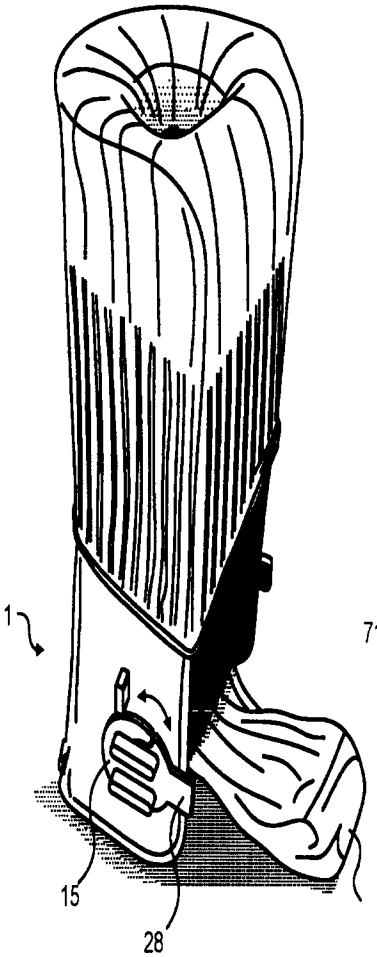
FIG. 3 is a view of a sock canister with a sock inserted.

To use the canister to assist in putting socks on, the sock is placed toe down into the interior of the sock canister with the heel toward the enclosed back and the toe out the open front as seen in FIG. 3. Several features have been specifically designed into the sock canister to enable it to function in this manner. The half cylinder design enables a sock to be placed on the canister and the foot of the user to enter the sock while not being stuck in the canister. The canister can be placed in a primarily horizontal position to start and transition to a primarily vertical position. The outer edge of the canister is reinforced. This reenforcing ridge 3 encompasses the outer edge of the canister. The reenforcing ridge 3 is rounded. Such a reenforced ridge is often referred to as a bead of material. The reenforcing ridge 3 is also polished to a mirror finish. This mirror finish reduces imperfections and places where a sock could catch, this leads to less resistance and limits the possibility of the sock catching or becoming stuck. On the outer surface of the sock canister 1 are two ridges that project out from the canister, these ridges, or sock stops 5 stop the cuff of the sock from moving further down the canister. The sock stops 5 assist a user in knowing how far to pull the sock over the canister.

At the base of the sock canister 1 are floor grips 7. The floor grips 7 grip the floor so that the sock canister 1 stays in place while the foot is being inserted into the sock. In some embodiments, the floor grips 7 are molded into the canister and covered in a grippy substance such as rubber. In some embodiments, the floor grips are molded into the canister and the bottom of the grip is made with grip features such as ridges and valleys.

The sock canister includes a heel transition opening 9 in the enclosed, back, side of the canister. The heel transition opening 9 assists in getting a foot into a sock. As a foot is inserted into a sock, the foot transitions from a primarily horizontal orientation to a primarily vertical orientation. As the foot undergoes this transition the heel protrudes back, the heel transition opening 9 enables the heel to have enough room to not get caught on the back of the sock canister. To further facilitate the transition of the foot from a primarily horizontal orientation to a primarily vertical orientation, a heel scoop 11 is located at the base of the heel transition opening 9. The heel scoop 11 flares back from the canister giving the heel an angled ramp to slide down. The heel scoop 11 reduces the chance of a sock covered heel catching on the edge of the heel transition opening and assists in a smooth process for putting on a sock. The sock canister has reinforcing ribs to provide strength to the canister without becoming too heavy.

Figure 5:
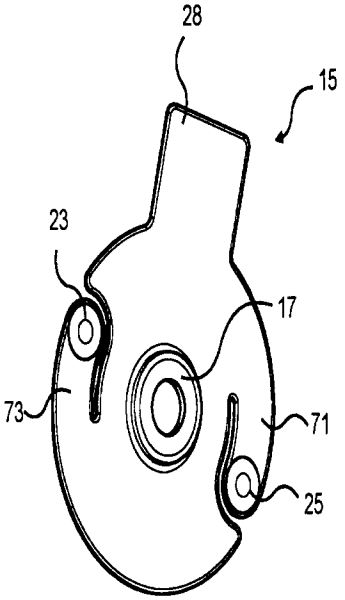
FIG. 5 is a view of one side of a connector disk.
Figure 4:
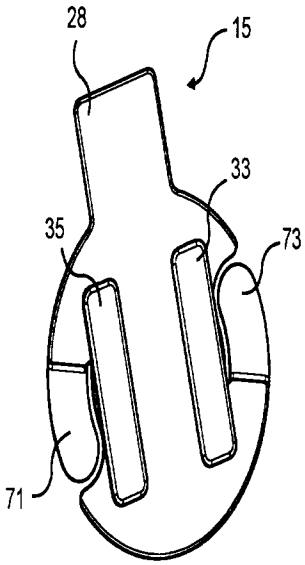
FIG. 4 is a view of one side of a connector disk.
Figure 6:
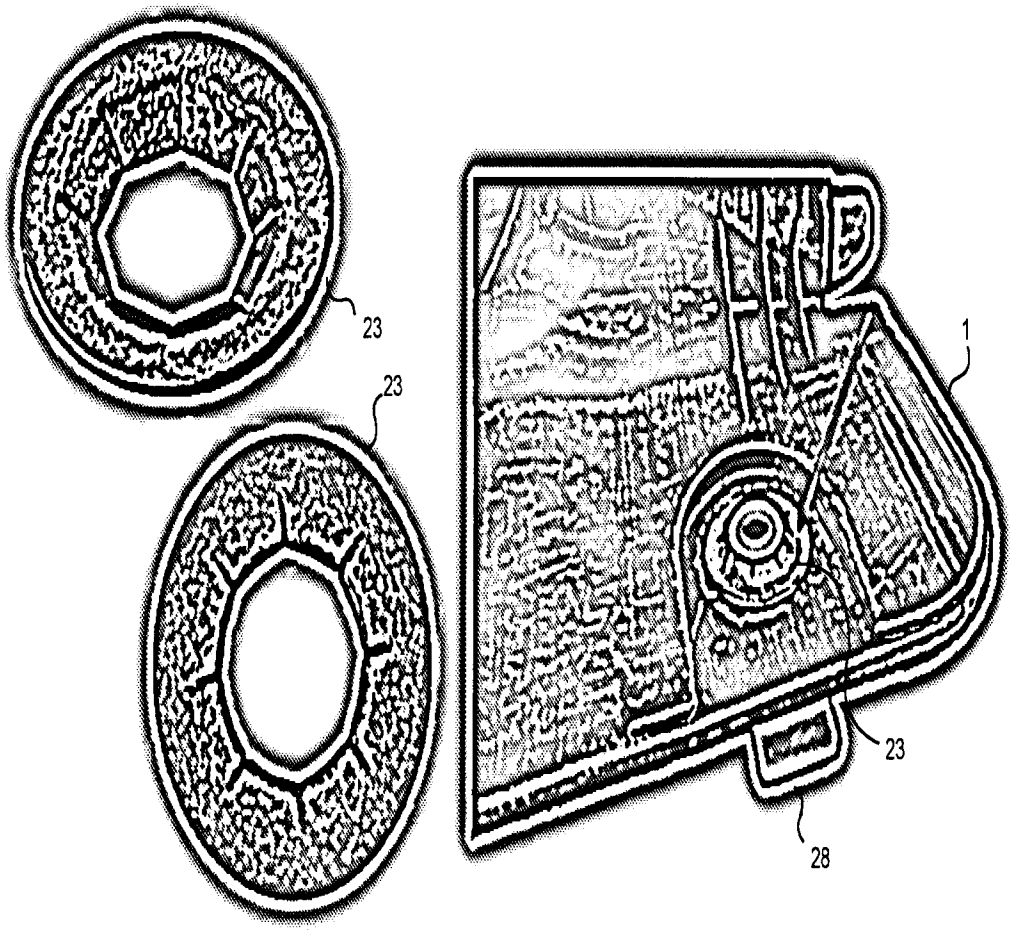
FIG. 6 is a depiction of a push retainer.

The sock aid is designed so that an individual does not have to bend over or reach down to put on a sock. The sock aid is designed so that the sock cylinder 1 rotates. In this way an individual could change the orientation and begin with the sock cylinder 1 in a horizontal orientation and as a foot is inserted into a sock rotate the cylinder to pull the sock on over the leg. To facilitate this rotation, handle connector disks, such as disc 15 attaches to the sock cylinder 1. There is a handle connector disk for each side of the sock cylinder. FIG. 4 shows a handle connection side of the handle connector disk. FIG. 5 shows a cylinder connection side of the handle connection disks. Each handle connector disk has an axle 17 which is inserted into the rotation aperture 19 and 21 of the sock cylinder 1. FIG. 6 shows the push retainers that keep the connector disks in place. A push retainer 23 holds each connector disk in place. The push retainers have a low-profile design and is removeable if necessary.

A position lock keeps the cylinder in place relative to the handle. The position lock has a component on the cylinder and a component on the connector disk. Each connector disk has a side facing the sock cylinder and a side that faces away from the sock cylinder. On the side facing the sock cylinder 1, the connector disks, such as disk 15, include protrusions which are position posts 23 and 25, that fit into divots, position divots such as position divot 27, on the sock cylinder. In many embodiments, there are two position posts, that are across the diameter of the disk from each other. These position posts are designed so that they slide into and out of corresponding position divots in the sock cylinder. The position posts and position divots hold the connector disks in position relative to the sock cylinder. The position posts and position divots work together to keep the handle connector disks and the handles from moving too easily relative to the sock cylinder. The disks include spring flaps, such as flaps 71 and 73. These flaps enable the posts to disengage from the position divots. The spring flaps permit the position posts to move in and out of the position divots while maintaining sufficient pressure to keep the posts within the divots.

The handle connector disk and therefore the handles do need to be able to move relative to the sock cylinder. The position posts and position divots are beveled to enable the posts to slide into and out of the position divots. The bevel on the position posts begins at the tip of the post. The bevel in the position divot does not reach the bottom of the divot. In this way the position posts and position divots work in conjunction to enable rotation of the handle connector disk without permitting unimpeded rotation of the handle connector disks.

The handles are movable relative to the sock cylinder. The foot is most comfortable in a perpendicular position to the lower leg. For some individuals it can be difficult to move the foot from a position perpendicular to the lower leg. This limited mobility impairs the ability to put clothing and particularly socks on. As has been described, when putting on a sock, the shaft of a sock is placed over the sock cylinder, with the heel of the sock toward the back of the sock cylinder and the toes pointing out of the cylinder. The shaft of the sock is placed over the cylinder such that the exterior side of the sock is in contact with the cylinder and the interior side is open to accept the foot and lower leg as seen in FIG. 3. The cylinder is initially placed in a horizontal position, with the handles substantially perpendicular to the cylinder, and the foot is placed within the sock. As the toes of the user reach the heal of the sock, the connector disk 15 is rotated so the protrusion 28 moves from substantially perpendicular to the cylinder to substantially parallel to the cylinder, causing the cylinder to move from a horizontal position to a vertical position. The movement of the cylinder from horizontal to vertical may be accomplished in one large step or in multiple small steps. The position posts and position divots are designed so that they will hold the connector disk in place but can be moved between positions according to the relative rotation between the connector disks and the cylinder.

Figure 7:
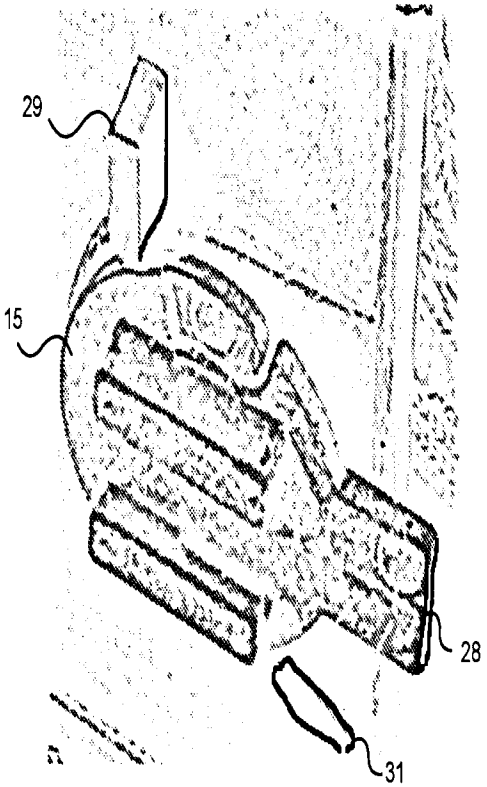
FIG. 7 is a view of a connector disk and upper and lower position stops.
Figure 11:
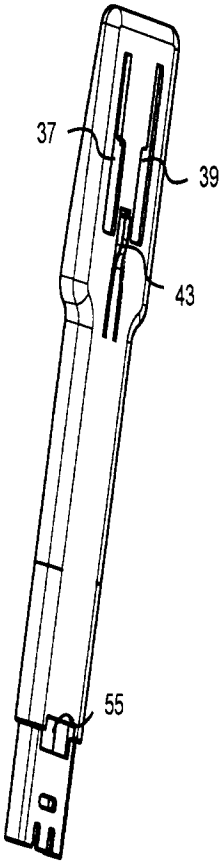
FIG. 11 is a view of a handle section without a clothes hook.

Additionally, the handle connector disks are designed so that the position posts have a limited range of movement. The material of the handle connector disk is formed so that there is a spring in the disks. When the handle connector disks are rotated the material of the disk above the post flexes to allow movement of the position post and assist in moving the position post out of the position post it is in and to another position divot. The handle connector disks also have a protrusion 28 from the outer edge of the disk. This protrusion 28 works with rotation stops on the sock cylinder to prevent rotation of the connector disk that would not be helpful. stops on the sock cylinder to prevent rotation of the connector disk that would not be helpful. There is an upper rotation stop 29 and a lower rotation stop 31 on each side of the sock cylinder. In this way the handle connector disks and therefore the handles will be kept in a useful alignment. As can be seen in FIGS. 3 and 7, the disk will rotate through more than ninety degrees. The rotation stops will prevent the disk from moving beyond this range. The range of the stops encompasses the useful range of the device.

FIG. 7 is a close-up view of the handle connector disk attached to the sock cylinder.

Figure 8:
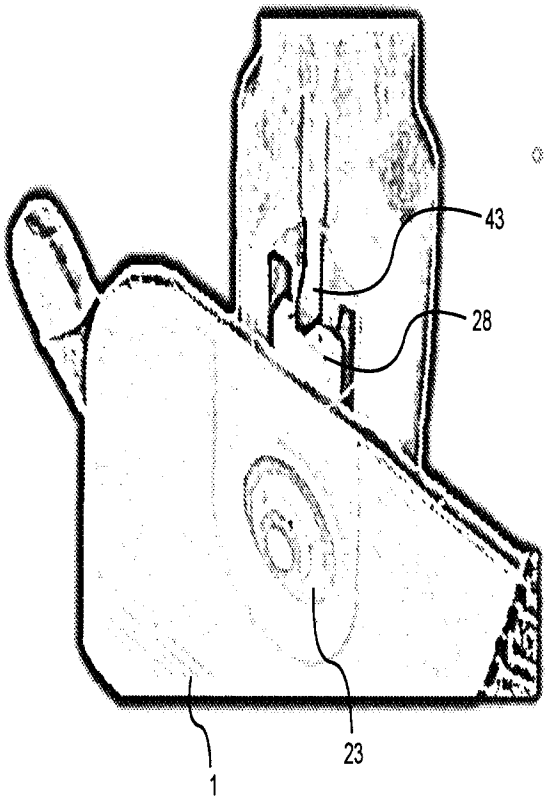
FIG. 8 is a view of a connector disk locked in place on a handle section.

FIG. 8 is a view of the handle attached to the connector disk 15. The handle is held in place on the connector disk by button lock 43.

Figure 10:
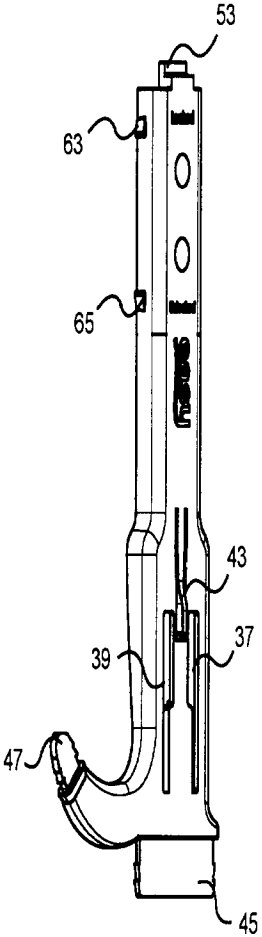
FIG. 10 is a view of a handle section with a clothes hook.
Figure 9:
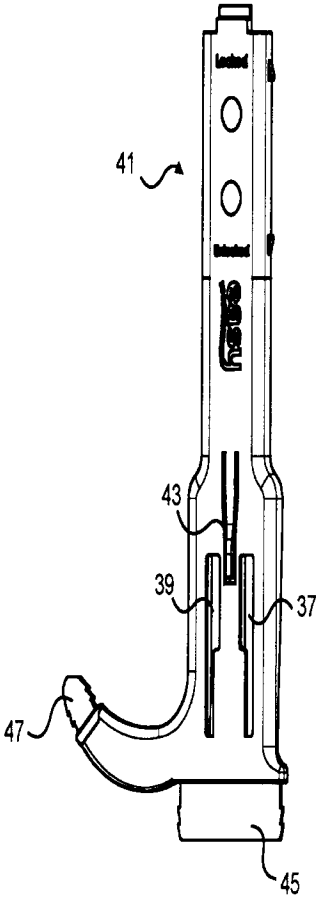
FIG. 9 is a view of a handle section with a clothes hook
Figure 14:
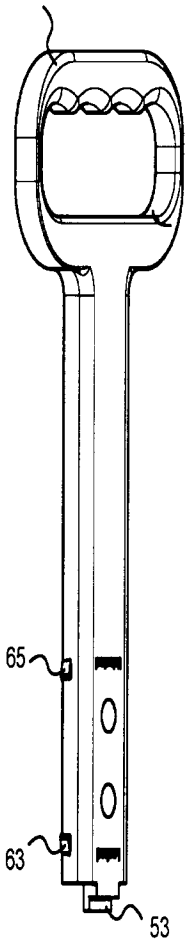
FIG. 14 is a front view of a handle section with a handle.
Figure 13:
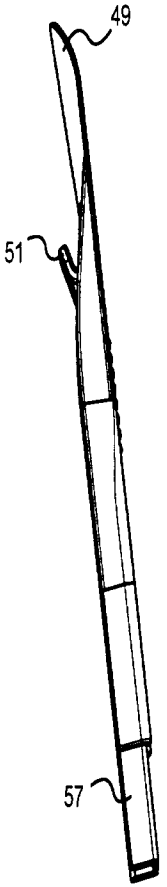
FIG. 13 is a side view of a handle section with a shoehorn and sock remover.
Figure 12:
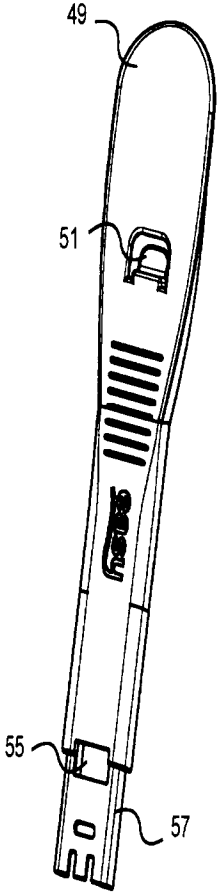
FIG. 12 is a front view of a handle section with a shoehorn and sock remover.
Figure 15:
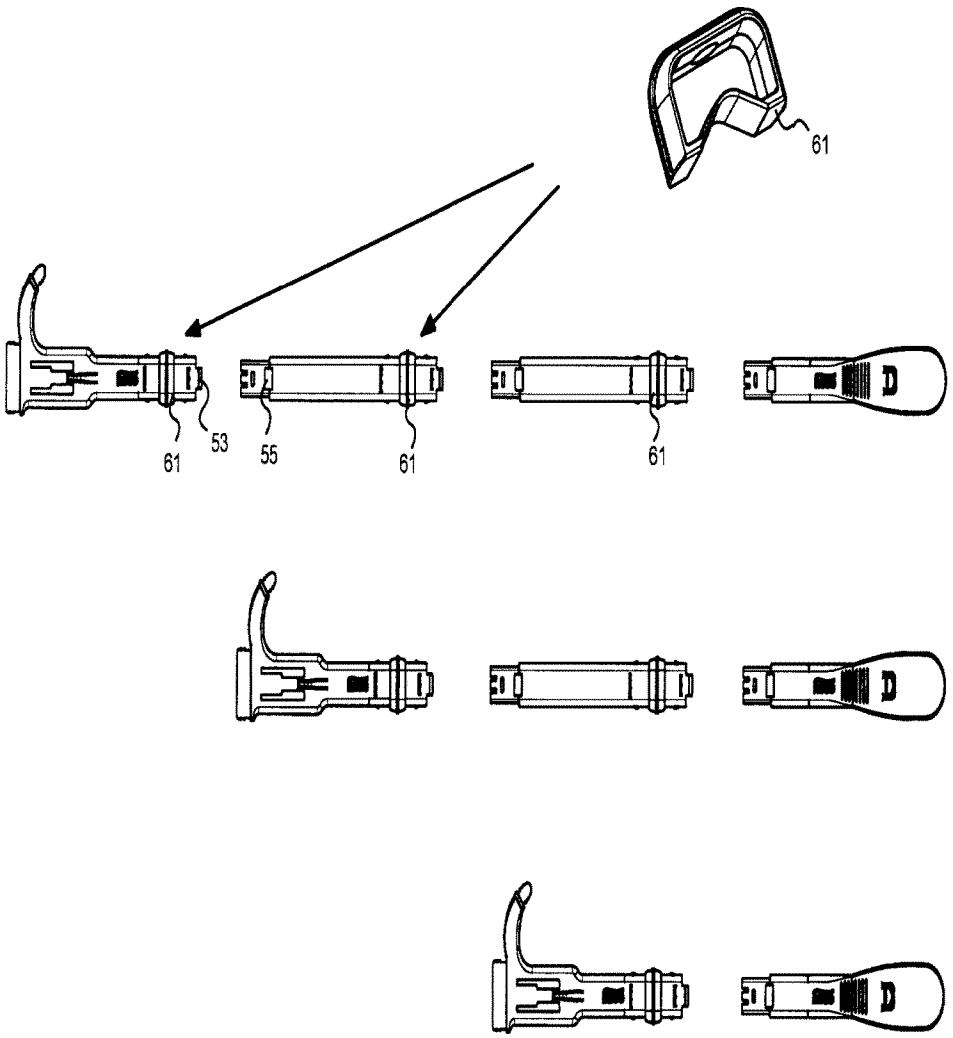
FIG. 15 is a depiction of the possible configurations of the handle.

On the side of the handle connector disks that faces away from the sock cylinder is the mechanism for attaching the handles to the connector disks. The connection mechanism is a sliding tongue and groove mechanism. FIGS. 9 and 10 show handle sections with dressing hooks. Extending from the connector disks are two tongues 33 and 35. Each tongue fits into a corresponding groove 37 and 39 in the handle section 41. The tongues are L-shaped, that is they have a straight portion with an overhanging portion. The L-shapes face each other. As the L-shaped tongues are inserted into the grooves of the handle the handle material is captured between the overhanging portion and the face of the connector disk. The overhanging portion holds the handle in place and keeps it from sliding away from the connector disk. The handle includes a button lock 43 that abuts the disk protrusion 28 and keeps the handle and connector disk 15 in place relative to one another. In some embodiments, the handle includes grip portions 45 on the end of the handle. These grip portions assist in keeping the sock cylinder from sliding away from the user or sliding with the user when it is necessary to hold the cylinder in position to get the sock on.

In some embodiments, one of the handle sections includes a dressing hook 47. A dressing hook can assist in picking things up off the floor or in positioning clothing in the proper place to put on.

There are several handle sections that lock together to extend the handles. Additionally, the handle sections can be configured to form a combination dressing hook shoehorn. FIGS. 12-15 show various sections of the handle along with various combinations of connections for the handles. The dressing hook shoehorn is typically formed from four pieces and has a length of thirty-six inches. On one end is the dressing hook with the grooves for the attachment mechanism for the sock aid, as has been previously described. On the other end is the shoehorn. The shoehorn 49 is used to assist in getting shoes on. The shoehorn 49 includes a sock remover 51. The sock remover 51 is a protrusion that sticks out the back from the shoehorn. The sock remover 51 enables the shoehorn to be inserted in between the sock and the leg, the sock remover then catches the cuff of the sock and as the shoehorn/sock remover is pushed down the sock is removed from the leg and then the foot.

The handle sections are in many embodiments made from plastic. In some embodiments, the plastic is ABS plastic. In some embodiments, the plastic is another suitable plastic. In some embodiments, the handle sections are made from another synthetic material such as carbon fiber, grilamid, fiberglass reinforced nylon (FRN), or other manufactured materials. In some embodiments, the handle sections are made from a metal. In some embodiments, the metal is aluminum, or an aluminum alloy. In some embodiments, the metal is stainless steel. In other embodiments, the metal is titanium, magnesium, or alloys of these metals.

The handle sections are designed to fit together. The sections interlock. A portion of one section fits within a portion of another section. For example tongue 53 fits within aperture 55 and portion 57 fits under handle section 59. Each handle section has one of the interlocking pieces so that the handle sections may be fit together. The pieces snap together and are held in place by the interlocking of the portions. To further strengthen and solidify the connection locking rings 61 slide over the joined sections. These rings are shaped to encompass the handle sections. As the ring locks slide into place lock tabs on the handle sections hold the lock rings in place. Each section includes a set of lock tabs. The upper lock tabs, such as lock tab 63, stop the lock ring in the locked position and the lower lock tabs, such as lock tab 65, stop the lock ring in the unlocked position. The lock tabs keep the lock rings from sliding off the handle sections when the handle is disassembled. Each handle section is about ten inches in length. The fully assembled length of the handle is about thirty-six inches. Some of the overall length is lost when the handle sections are put together, due to the overlapping portions. Each section will interlock with any other section so the handle can be assembled in many configurations. The handle can be assembled with two sections, or three sections, or with all four sections.

Additional handle sections include handle grips. The handle grips are grips perpendicular to the handle shafts. The grips allow a user to more easily grasp the handle and pull a pair of socks on.

All patents and published patent applications referred to herein are incorporated herein by reference. The invention has been described with reference to various specific and preferred embodiments and techniques. Nevertheless, it is understood that many variations and modifications may be made while remaining within the spirit and scope of the invention.

What is claimed is:

1. A dressing aid comprising:

a sock aid comprising:

a sock canister comprising:

a reinforced edge;

a heel transition opening;

a pivot aperture;

a connection disk comprising;

an axle for the pivot aperture to rotate on;

a handle connection mechanism;

a push retainer for holding the connection disk to the sock canister; and a handle wherein the sock canister is configured to enable a sock to be placed on it to facilitate putting a sock on a foot;

wherein the sock canister rotates around the axle of the connection disk enabling the sock canister to rotate as a foot is placed in the sock, and to remove the sock from the canister as the foot is placed in the sock.

2. The invention of claim 1, further comprising a dressing hook on one end of the handle.

3. The invention of claim 1, further comprising a heel scoop at the base of the heel transition opening.

4. The invention of claim 1, wherein the handle is removable from the connection disk.

5. The invention of claim 4, wherein the handle comprises multiple interlocking sections.

6. The invention of claim 5, wherein the two pivot apertures are located on opposite sides of the sock canister.

7. The invention of claim 5, wherein the two pivot apertures are located on opposite sides of the sock canister.

8. The invention of claim 5, wherein the two pivot apertures are located on opposite sides of the sock canister.

9. The invention of claim 4, wherein the handle comprises multiple interlocking sections.

10. The invention of claim 1, further comprising two pivot apertures, two connection disks, and two handles.

11. The invention of claim 1, further comprising a position lock.

12. The invention of claim 11, wherein the position lock comprises position divots on the sock canister and position posts on the connection disk.

13. The invention of claim 1, further comprising a heel scoop at the base of the heel transition opening.

14. The invention of claim 1, wherein the handle is removable from the connection disk.

15. The invention of claim 1, further comprising two pivot apertures, two connection disks, and two handles.

16. The invention of claim 1, wherein the handle is removable from the connection disk.

17. The invention of claim 1, further comprising two pivot apertures, two connection disks, and two handles.

18. The invention of claim 1, further comprising a position lock.

19. A dressing aid comprising:

a sock aid comprising:

a sock canister comprising:

a reinforced edge;

a heel transition opening;

a pivot aperture;

a connection disk comprising;

an axle for the pivot aperture to rotate on;

a handle connection mechanism;

a push retainer for holding the connection disk to the sock canister;

a handle;

a dressing hook;

a shoehorn;

a sock remover.

20. A dressing aid comprising:

a sock aid comprising:

a sock canister comprising:

a reinforced edge;

a heel transition opening;

a pivot aperture;

a connection disk comprising;

an axle for the pivot aperture to rotate on;

a handle connection mechanism;

a push retainer for holding the connection disk to the sock canister;

a handle;

a position lock;

wherein the sock canister is configured to enable a sock to be placed on it to facilitate putting a sock on a foot;

wherein the sock canister rotates around the axle of the connection disk enabling the sock canister to rotate as a foot is placed in the sock, and to remove the sock from the canister as the foot is placed in the sock.

* * * * *